US005322233A

United States Patent [19]

Hehner et al.

[11] Patent Number: 5,322,233

[45] Date of Patent: Jun. 21, 1994

[54] GUIDE HEAD FOR HEAVY WINDING ROLLS

[75] Inventors: Reinhard Hehner, Haan; Ewald G. Welp, Erkrath; Georg Müller, Neuss, all of Fed. Rep. of Germany

[73] Assignee: Jagenberg Aktiengesellschaft, Dusseldorf, Fed. Rep. of Germany

[21] Appl. No.: 974,598

[22] PCT Filed: Jun. 29, 1992

[86] PCT No.: PCT/EP92/01460

§ 371 Date: Feb. 13, 1993

§ 102(c) Date: Feb. 13, 1993

[87] PCT Pub. No.: 1X1093/01116

PCT Pub. Date: Jan. 21, 1993

[30] Foreign Application Priority Data

Jul. 13, 1991 [DE] Fed. Rep. of Germany ..... 4123304

[51] Int. Cl.[5] ..... B65H 16/06; B65H 18/10

[52] U.S. Cl. ..... 242/68.4

[58] Field of Search ..... 242/68.4, 68.1, 68.2, 242/68.3, 129.51, 129.53, 72 R, 72 B; 269/47, 52

[56] References Cited

U.S. PATENT DOCUMENTS

| | | | |
|---|---|---|---|
| 3,215,358 | 11/1965 | Way | 242/68.3 |
| 3,797,772 | 3/1974 | Lucas | 242/68.2 X |
| 4,105,171 | 8/1978 | Sciola et al. | 242/68.4 |
| 5,123,605 | 6/1992 | Hehner et al. | 242/68.1 X |

FOREIGN PATENT DOCUMENTS

| | | |
|---|---|---|
| 2526497 | 11/1976 | Fed. Rep. of Germany . |
| 2612375 | 10/1977 | Fed. Rep. of Germany . |
| 618661 | 8/1980 | Switzerland . |

*Primary Examiner*—John M. Jillions
*Attorney, Agent, or Firm*—Herbert Dubno; Yuri Kateshov

[57] ABSTRACT

The guide head for heavy rolls includes a bracket, a nonrotatable trunnion formed with three parts each having a respective outer surface, a rotatable hollow guide formed with a an annular surface, a radial bearing spaced radially inwardly from the inner surface of the guide and forming therewith a an annular clearance receiving an elastic O-ring capable of deforming under the load mounted on the guide.

8 Claims, 1 Drawing Sheet

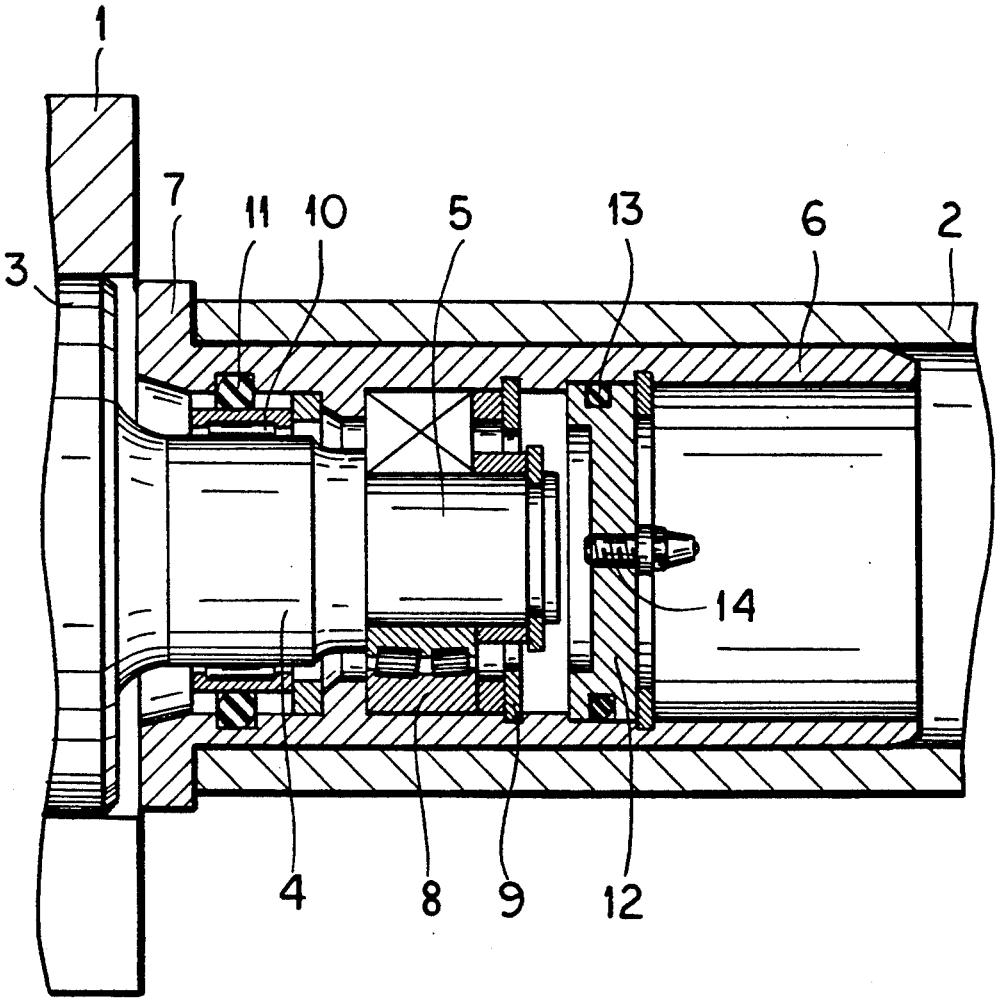
1
7
11
10
5
13
6
2
3
14
4
8
9
12

GUIDE HEAD FOR HEAVY WINDING ROLLS

CROSS REFERENCE TO RELATED APPLICATIONS

This application is a national phase application corresponding to PCT/EP92/01460 filed 29 Jun. 1992 and based, in turn, upon an application P41 23 304.2 filed in Germany on 13 Jul. 1991 under the International Convention.

FIELD OF THE INVENTION

The invention relates to a guide head for heavy winding rolls and, particularly, for heavy winding rolls with a guiding element insertable in a core of the winding roll.

BACKGROUND OF THE INVENTION

Guide heads are used in winding machines for winding or unwinding of winding rolls consisting of paper or cardboard webs, for holding the winding rolls during winding or unwinding operation. Two guide heads, freely rotatably or drivably supported in the winding machine (e.g in winding brackets) are introduced on each side into the winding core of the winding roll.

If the winding rolls are not supported during winding and unwinding, e.g. by a support or bearing cylinder, in the case of particularly heavy winding rolls the intrinsic weight of the roll can cause the bending of the cores, which are usually made of cardboard, in the area between the two guide heads, causing roll defects. In this case the roll turns slightly eccentrically in the core area, resulting in restoring forces during rotation, which lead to displacements in the wound-up layers. These displacements in the wound-up layers can cause bursting or crinkling in the core area.

From DE 25 26 497-B1 a generic grip head mounted to the end of a drivable shaft is known, which consists of a guide part and a torque-transmitting part. The guide part comprises a hub nonrotatably connected to the shaft end, with a cylindrical, slightly spherical surface, surrounded by a bearing sleeve. At its one end close to the shaft end, the bearing sleeve has circumferentially distributed axial slots in order to be able to perform inclinations, so that its peripheral surface can follow the flexing of the winding core. The second part nonrotatably connected to the guide part comprises a segmented sleeve with multiple axial slots and with pressure elements, pushing the segments radially to the outside when the segmented sleeve is rotated, so that torque can be transmitted. With respect to the second part, the first part has radial play and can be inclined, so that it can adjust to the alignment of the core. Due to the adjustment of the two parts to the flexing of the winding core, the strain exerted on the ends of the winding core is reduced.

This grip head of a very expensive construction with radially expanding grip segments is designed for the transmission of torque. The guide part is nonrotatably mounted on the driven shaft, which for this reason requires an expensive pivoting support arrangement in the winding machine.

OBJECT OF THE INVENTION

It is the object of the invention to provide a guide head having simple construction and capable to adjust to the flexing of a core.

According to the invention the guide part is rotatably supported on a nonrotatable trunnion, which therefore is easily supported in the winding machine. When no external radial forces are acting, the support element centers the guide part coaxially with respect to the trunnion axis, so that the guide heads can be introduced into the new winding cores without problems.

The arrangement of the pivot bearing in the area of the trunnion end, i.e. outside the machine part to which the guide head is fastened, has the further advantage that the nonrotatable trunnion can be axially slidably supported in a constructively simple manner, e.g. by means of a centrally engaging worm drive. Since the two guide heads holding a winding core have to be pulled away from each other in axial direction when a wound-up roll has to be discharged or a new winding core has to be inserted, this can be done without moving the machine part to which the guide heads are attached. The guide heads can be simply lowered into the machine part.

BRIEF DESCRIPTION OF THE DRAWING

The above and other objects, features and advantages of the invention will become more readily apparent from the following description, reference being made to the accompanying highly diagrammatic drawing in which:

FIG. 1 is a longitudinal section through a guide head according to the invention.

SPECIFIC DESCRIPTION

The guide head shown in FIG. 1 serves for holding the winding roll during winding in a winding machine. The known winding machines for winding heavy winding rolls of paper or cardboard webs have individual winding stations each consisting of two winding brackets 1, one of which is partially shown in FIG. 1. A further closer described guide head, insertable into the winding core 2 of a winding roll, is mounted on each winding bracket 1. The guide head consists of a trunnion 3, 4, 5 with a circular cross section which is supported nonrotatably and axially slidable by means of a worm drive in order to be introduced with its part 3 into the winding bracket 1 while the winding cores are replaced. In the extended working position according to FIG. 1 the end of trunnion 3 consisting of two parts 4, 5 with respectively decreasing diameters is located outside the winding bracket 1. An external guide element 6 shaped like a hollow cylinder is rotatably mounted on parts 4, 5, its outer diameter being adjusted to the inner diameter of core 2. The guide element 6 has a rim-like stop 7 for the winding cores 2 at its end facing the winding bracket 1, at its other end it extends over the parts 4, 5 of the trunnion 3 approximately by the length of these parts.

The guide element 6 is fastened rotatably and tiltably to a limited extent on trunnion 3 by means of a radial bearing 8 capable of angular movement, which is arranged in the area of the external part 5. Preferably the angularly movable radial bearing 8 is a self-aligning roller bearing (as in the present case) or a self-aligning ball bearing, whose outer bearing race is fitted to the inner surface of guide element 6 and whose inner bearing race is fitted to the outer surface of trunnion part 5. The self-aligning roller bearing 8 is secured against axial displacement by means of a retaining ring 9.

The initial portion of the guide element 6 is rotatable about the trunnion part 4 and is supported by a peripheral support element deformable in a radial direction. For this on trunnion part 4 sits a needle bearing 10, over whose outer bearing race an elastic O-ring 11 is pulled. The O-ring 11 pushes the guide element 6 along with the core 2 in a coaxtial position with respect to the axis of trunnion 3, as long as there are no acting external forces, e.g. the weight of the roll. At the same time, the O-ring 11 seals the guide head on the inside, on its side facing the winding bracket 1.

At a short distance from the end of trunnion part 5, the guide element 6 is closed on the inside by a plate 12 sealed by sealing ring 13 and provided with central lubrication opening 14. Through the lubrication opening 14 lubricant can be supplied to the thereby closed space with the two bearings 8, 10.

During the winding and unwinding of heavy winding rolls (width>2300 mm, diameter>1150 mm), the core 2 of the winding roll laterally held by the two guide heads is bent due to the own weight of the rolls. The guide element 6 of the guide head is capable of following the flexing of core 2 and it adjusts to the flexing of core 2 by tilting vertically with respect to the trunnion axis. The tilting motion is, limited by the O-ring 11, and the tilting angle reaches a maximum of 10°, preferably between 0.5 and 5°. Due to the adjustment of guide element 6 to the flexing of core 2, during winding and unwinding the restoring forces causing the displacement of wound layers can be basically avoided. These layer displacements at the core area of the winding roll can lead to bursting and crinkling and therefore is practically eliminated.

We claim:

1. A guide head for heavy winding rolls comprising:

a bracket;

a trunnion mounted rotatably fixed on the bracket and including outer, intermediary and inner parts centered on an axis and formed with respective annular outer surfaces;

a rotatable hollow guide formed with a cylindrical outer surface and an inner annular surface, the inner surface of the guide being spaced radially outwardly from the respective outer surfaces of the intermediary and inner parts of the trunnion;

a self-aligning bearing mounted between the inner surface of the guide and the outer surface of the inner part of the trunnion;

a radial bearing mounted on the intermediary part and spaced radially inwardly from the inner surface of the guide to form an annular clearance with the guide;

an elastic O-ring between the radial bearing and the guide and lying in a plane of the radial bearing extending perpendicular to the axis, the O-ring bridging the annular clearance and engaging the inner surface of the guide; and a core of the roll to be wound mounted rotatably on the guide, the guide being tiltable under the load thereby compressing the O-ring in the clearance and tiltable back by the bearings and O-ring generating respective restoring forces upon removing the load.

2. The guide head defined in claim 1 wherein the core is formed with a respective inner annular surface engaging the outer surface of the guide.

3. The guide head defined in claim 1 wherein the self-aligning bearing is a self-aligning roller bearing.

4. The guide head defined in claim 1 wherein the self-aligning bearing is a ball bearing.

5. The guide head defined in claim 5 wherein the guide is formed with a flange extending radially outwardly from the outer periphery of the guide between the bracket and a respective end of the core and radially projecting beyond the core, so that the flange is in axial contact with the bracket and with the end of the core.

6. The guide head defined in claim 2 wherein the inner periphery of the core and the outer periphery of the guide are in continuous contact at least over a length of the guide between said O-ring and said self-aligning bearing.

7. The guide head defined in claim 1 wherein the guide is formed with a plate sealingly closing the interior of said guide inwardly of said trunnion.

8. The guide head defined in claim 1 wherein the radial bearing is a roller bearing.

* * * * *